US010981715B2

(12) United States Patent
Song

(10) Patent No.: US 10,981,715 B2
(45) Date of Patent: Apr. 20, 2021

(54) CONTAINER WITH AN AIR GAP

(71) Applicant: Seungwoo Song, Anaheim, CA (US)

(72) Inventor: Seungwoo Song, Anaheim, CA (US)

( * ) Notice: Subject to any disclaimer, the term of this patent is extended or adjusted under 35 U.S.C. 154(b) by 175 days.

(21) Appl. No.: 16/397,984

(22) Filed: Apr. 29, 2019

(65) Prior Publication Data

US 2020/0339336 A1 Oct. 29, 2020

(51) Int. Cl.
*B65D 3/22* (2006.01)
*B65D 81/38* (2006.01)

(52) U.S. Cl.
CPC ..... *B65D 81/3869* (2013.01)

(58) Field of Classification Search
CPC ... B65D 81/3869; B65D 81/3865; B65D 3/22
USPC ..... 220/738, 739; 229/403
See application file for complete search history.

(56) References Cited

U.S. PATENT DOCUMENTS 6,068,182 A * 5/2000 Tokunaga ..... B65D 3/22 220/738
6,412,686 B1 * 7/2002 Mahl ..... B65D 5/0281 220/738
8,387,857 B2 * 3/2013 Messerschmid ... B65D 81/3869 229/403
2017/0295969 A1 * 10/2017 Ben Ezri ..... B65D 81/3869

* cited by examiner

*Primary Examiner* — Stephen J Castellano
(74) *Attorney, Agent, or Firm* — Stephen Chai

(57) ABSTRACT

The present invention provides a container comprising a cup; a protective member attached to a side wall of the cup, the protective member including: an outer side wall portion; an inner side wall portion contacting the side wall of the cup; a bottom end portion connecting between a bottom end of the outer side wall portion and a bottom end of the inner side wall portion; and a top end portion connecting between a top end of the outer side wall portion and a top end of the inner side wall portion, the top end portion having at least one hole; and an air gap formed between a side wall of the cup and the protective member, wherein the at least hole allows air to flow between the air gap and outside.

18 Claims, 21 Drawing Sheets

CONTAINER WITH AN AIR GAP

FIELD OF THE INVENTION

The present invention pertains generally to the field of thermally insulated containers for storing beverages, and more particularly to a thermally insulated container with an air gap.

BACKGROUND OF THE INVENTION

When a hot beverage is poured into a cup, the cup surface temperature rises to an extremely high degree in a few seconds. This makes it difficult for a user to hold the cup and also pose the danger that user may get burned. Different kinds of cup assemblies or cup sleeves have been devised to take advantage of air as an insulating medium for cups.

However, most of these cup assemblies manufacturing requires special machinery and extra procedures, which leads to the high cost of manufacturing. Furthermore, cup sleeves also have their own limitations because they could be separated from the cups, which poses the danger that the cups may be dropped.

SUMMARY OF THE INVENTION

The present invention provides a container which includes a cup and a unique protective member with holes formed in a end portion of the protective member. Specifically, the cup and the protective member provide an air gap therebetween, and the holes formed in the top end portion of the protective member allow hot air in the air gap to escape from the air gap to outside, and cold air could flow into the air gap. The container also provides a stable structure because the protective member is fixed to the cup. Also, the container is cost effective because it can be manufactured easily without special machinery or complicated steps.

Embodiments of the inventive concept provide a container comprising a cup; a protective member attached to a side wall of the cup, the protective member including: an outer side wall portion; an inner side wall portion contacting the side wall of the cup; a bottom end portion connecting between a bottom end of the outer side wall portion and a bottom end of the inner side wall portion; and a top end portion connecting between a top end of the outer side wall portion and a top end of the inner side wall portion, the top end portion having at least one hole; and an air gap formed between a side wall of the cup and the protective member, wherein the at least hole allows air to flow between the air gap and outside.

Other embodiments of the inventive concept provide a container comprising a cup having an outwardly rolled rim on a top end; a protective member attached to a side wall of the cup, a top end of the protective member includes a first inwardly rolled rim and a bottom end of the protective member include a second inwardly rolled rim; at least one hole formed in a top end of the protective member, the at least one hole facing the outwardly rolled rim of the cup; and an air gap formed between a side wall of the cup and the protective member, wherein the at least hole allows air to flow between the air gap and outside.

Other embodiments of the inventive concept provide a container comprising a cup; a protective member attached to a side wall of the cup, a top end of the protective member includes a first inwardly rolled rim and a bottom end of the protective member include a second inwardly rolled rim; at least one hole formed in a top end of a side wall of the protective member; and an air gap formed between a side wall of the cup and the protective member, wherein the at least hole allows air to flow between the air gap and outside.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 20B is a close-up partial section view of a lower portion M8 of the container 90 of FIG. 19.

DETAILED DESCRIPTION EMBODIMENTS OF THE INVENTIONS

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as form "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1B:
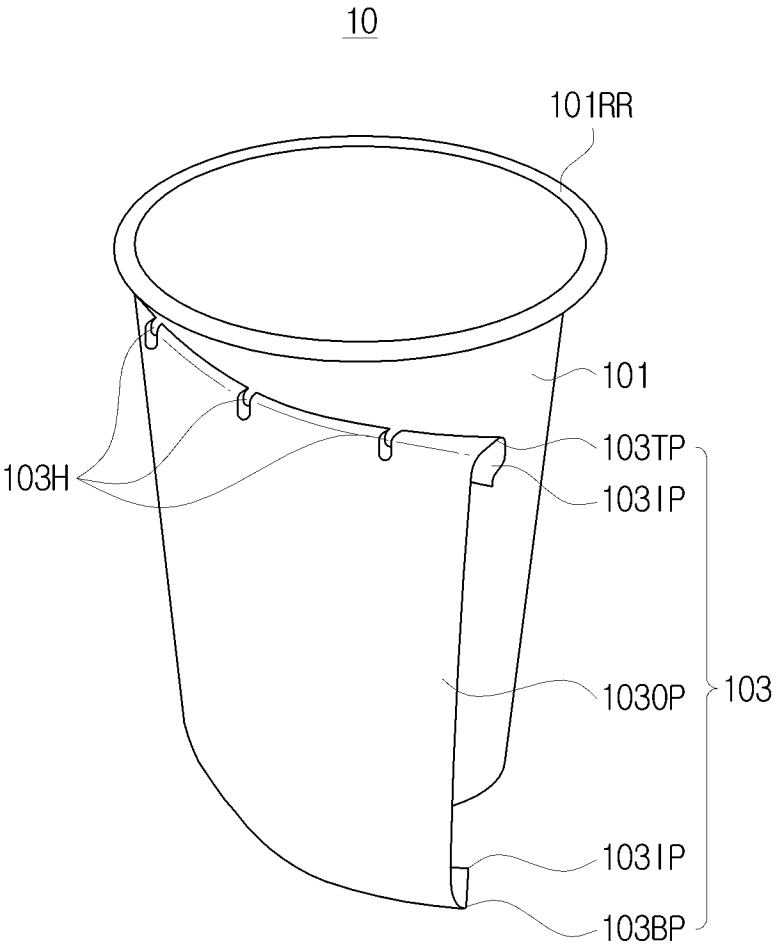
FIG. 1B shows a perspective view of the container 10 of FIG. 1A with a protective member 103 partly taken off from a cup 101.
Figure 1A:
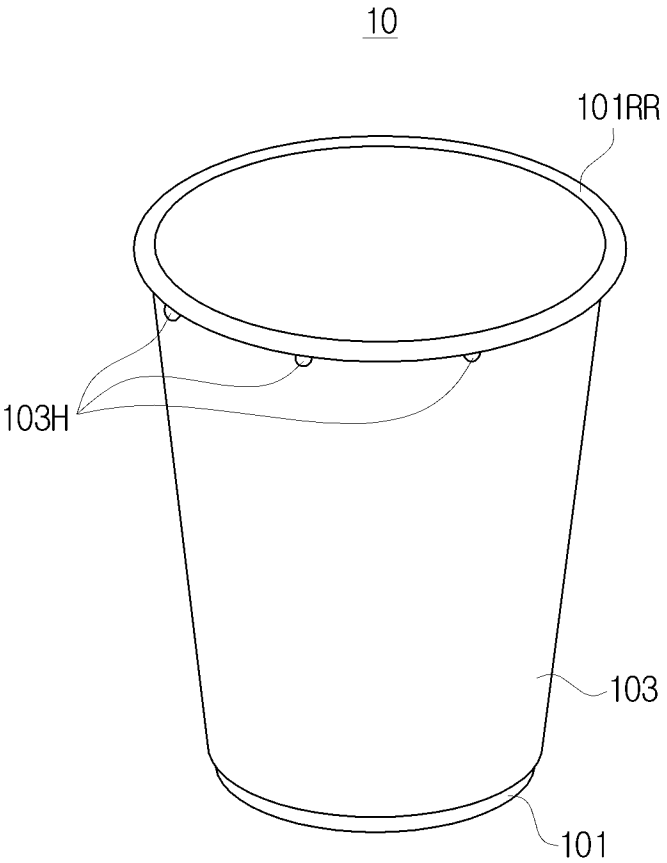
FIG. 1A shows a perspective view of a container 10 according to one embodiment of the present invention.

FIG. 1A shows a perspective view of a container 10 according to one embodiment of the present invention. FIG. 1B shows a perspective view of the container 10 of FIG. 1A with a protective member 103 partly taken off from a cup 101.

According to FIGS. 1A and 1B, the container 10 comprises a cup 101 and a protective member 103. The protective member 103 attaches to a side wall of the cup 101. The cup 101 may have an outwardly rolled rim 101RR in a top end but is not limited to.

The protective member 103 may include an outer side wall portion 1030P, an inner side wall 103IP, a bottom end portion 103BP, and a top end portion 103TP. The outer side wall portion 1030P may surround the side wall of the cup 101. The top end portion 103TP connects between a top end of the outer side wall portion 1030P and a top end of the inner side wall portion 103IP. The top end portion 103TP has at least one hole 103H. For example, the hole 103H may be one, two, three, four, five, or more. The bottom end portion 103BP connects between a bottom end of the outer side wall portion 1030P and a bottom end of the inner side wall portion 103IP. The top end portion 103TP and the bottom end portion 103BP may be arch-shaped. In other words, a top end of the protective member 103 includes a first inwardly rolled rim, and a bottom end of the protective member 103 include a second inwardly rolled rim. In another embodiment, the top end portion 103TP and the bottom end portion 103BP may be flat-shaped.

An air gap 105 is formed between the side wall of the cup 101 and the protective member 103. The air gap 105 is exposed to outside through the at least one hole 103H, which enables air to flow between the air gap 105 and outside. A width of the air gap 105 may be constant at any height but is not limited to. A width of the air gap 105 at a bottom of the container 10 may be different from that of a top of the container 10.

The hole 103H may extend to the outer side wall portion 1030P. Therefore, the hole 103H may be exposed a top end of the outer side wall portion 1030P. In FIGS. 1A and 1B, the holes 103H have a half circle shape but is not limited to. The holes 103H may have various shapes such as circle shapes, rectangular shapes, triangle shape, etc. The hole 103H may also extend to the inner side wall portion 103IP but is not limited to.

Figure 2:
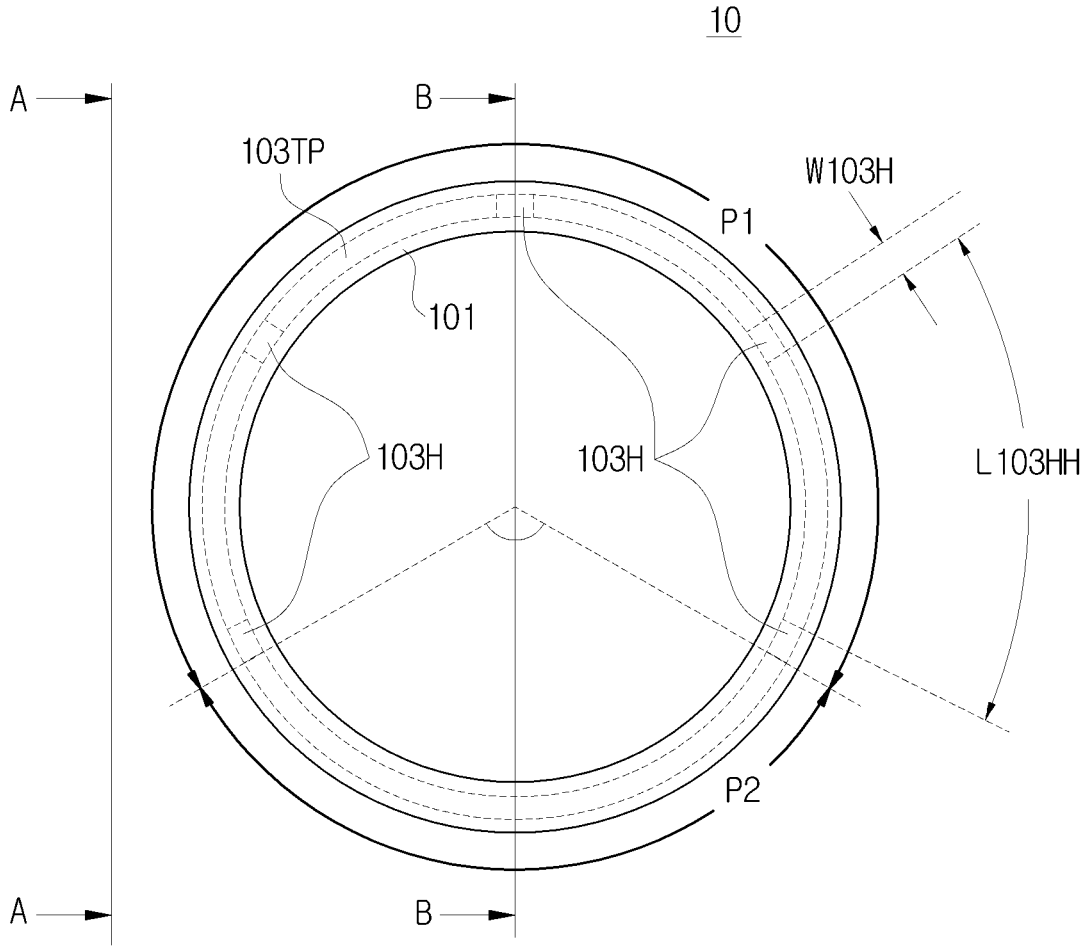
FIG. 2 shows a plan view of the container 10 of FIGS. 1A and 1B.
Figure 3:
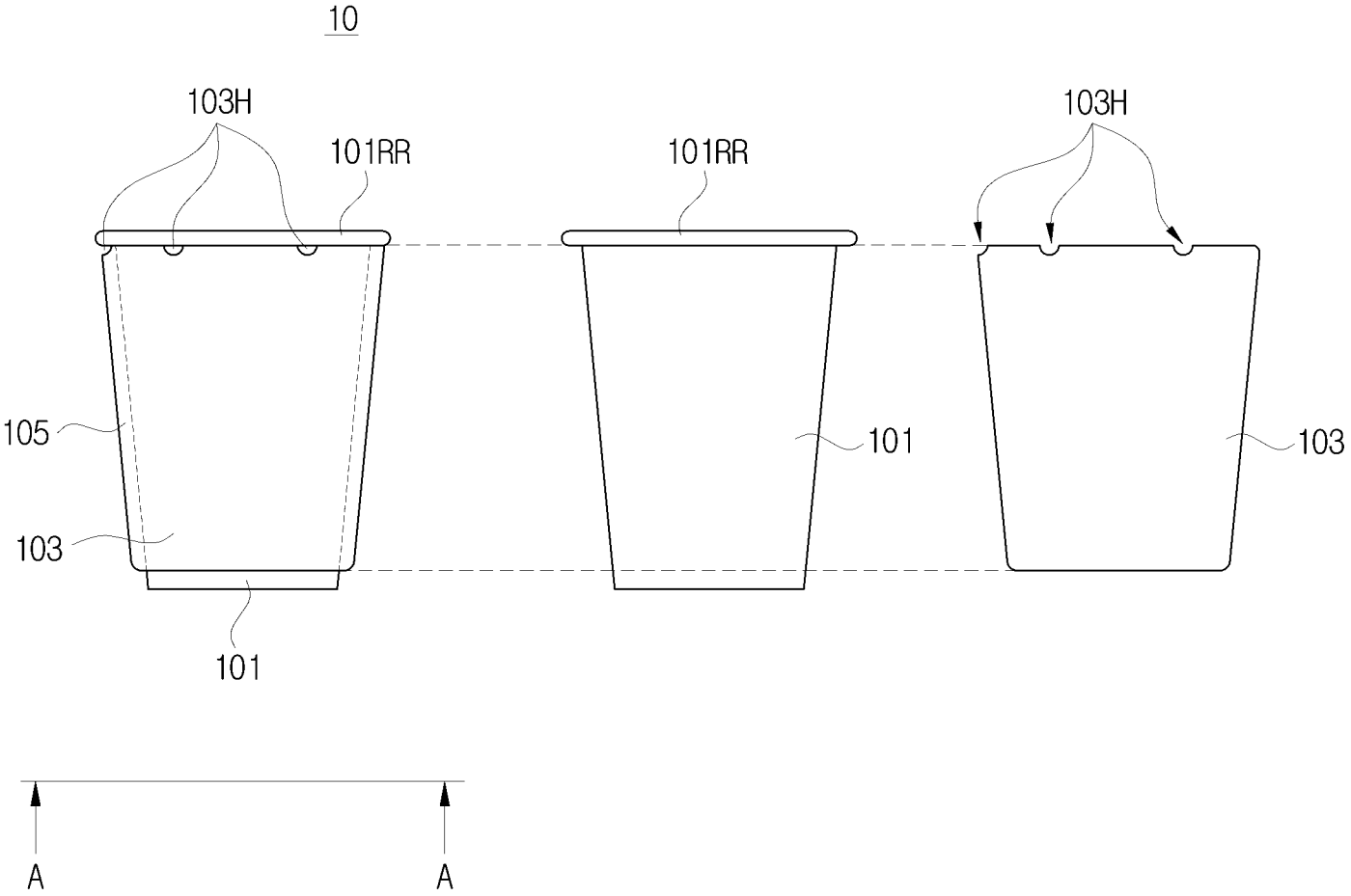
FIG. 3 shows a side view of the container 10 from line A-A shown in the FIG. 2 and an exploded view of the container 10.

FIG. 2 shows a plan view of the container 10 of FIGS. 1A and 1B. FIG. 3 shows a side view of the container 10 from line A-A shown in the FIG. 2 and an exploded view of the container.

According to FIG. 2, holes 103H are formed in a first part P1, two thirds portion of the top end portion 103TP. The remaining one third portion of the top end portion 103TP, a second part P2, does not include any holes. The second part P2 allows users to approach and touch their mouths to the container 10 without getting burned by hot air coming from the holes 103H. The holes 103H may be formed with constant distance between each other. A length L103HH between adjacent holes 103H along the circumference of the top end portion 103TP is longer than a diameter W103H of each hole 103H. Bridges between adjacent holes 103H in the top end portion 103TP can support the outer side wall portion 1030P to be apart from the side wall of the cup 101.

According to FIG. 3, the hole 103H may face a bottom 101RRB of the outwardly rolled rim 101RR of the cup 101. In addition, the holes 103H may be exposed in a top of the outer side wall portion 103.

Figure 4:
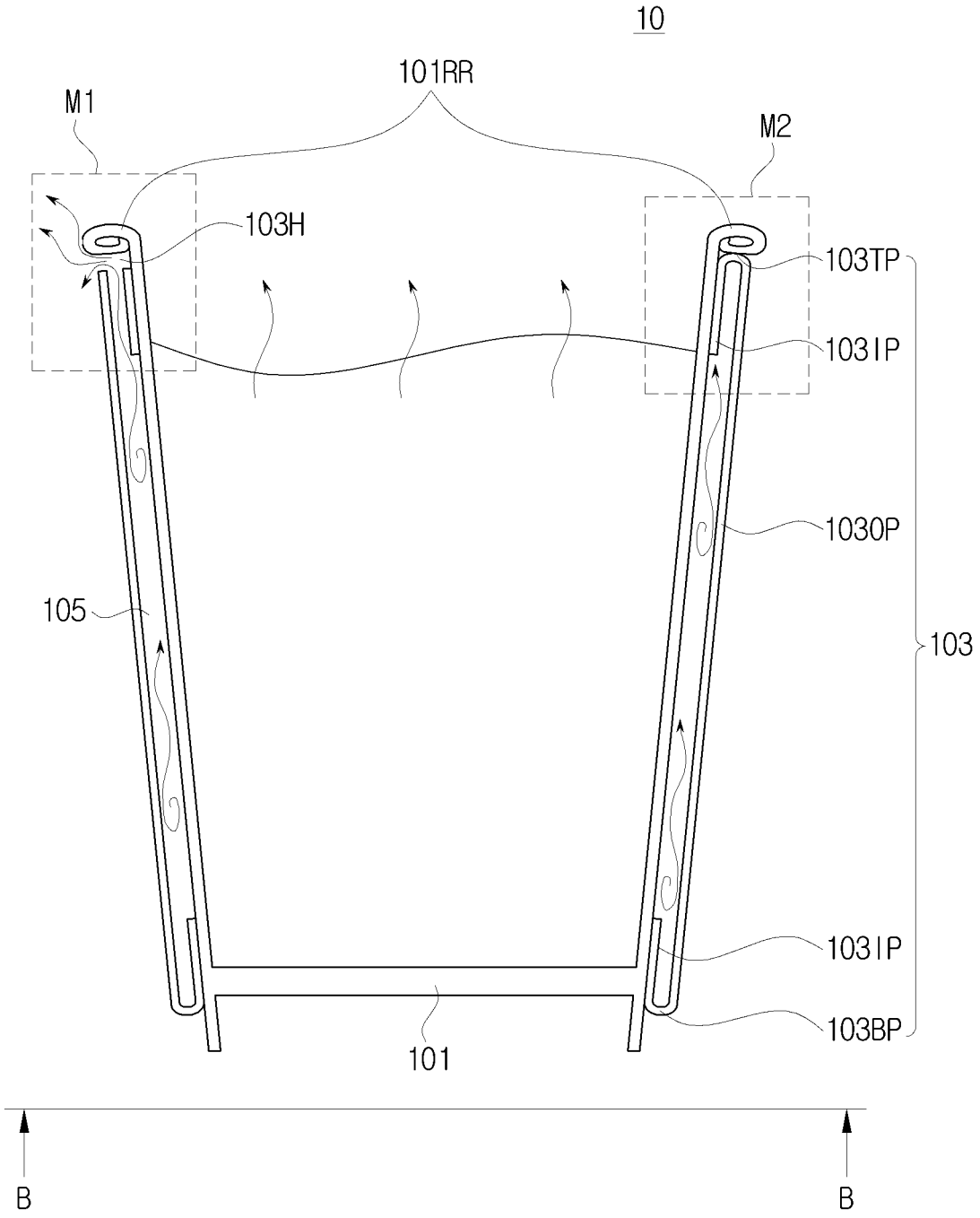
FIG. 4 shows a cross-sectional view of the container 10 along line B-B shown in the FIG. 2.
Figure 5A:
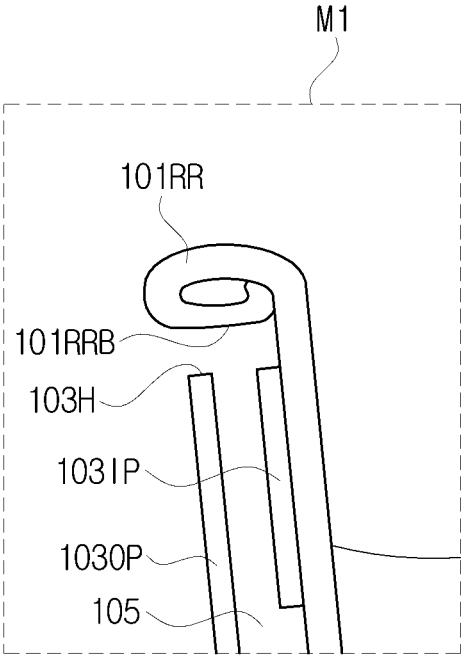
FIG. 5A is a close-up partial section view of an upper portion M1 of the container 10 of FIG. 4.
Figure 5B:
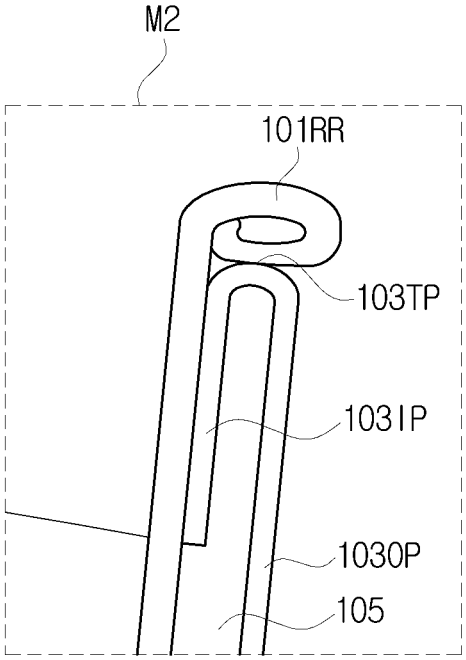
FIG. 5B is a close-up partial section view of an upper portion M2 of the container 10 of FIG. 4.

FIG. 4 shows a cross-sectional view of the container 10 along line B-B shown in the FIG. 2. FIG. 5A is a close-up partial section view of an upper portion M1 of the container 10 of FIG. 4. FIG. 5B is a close-up partial section view of an upper portion M2 of the container 10 of FIG. 4.

According to FIG. 4, the air gap 105 is exposed to outside through the at least one hole 103H, which enables air to flow between the air gap 105 and outside.

According to FIG. 5A, the hole 103H may face a bottom 101RRB of the outwardly rolled rim 101RR of the cup 101. In addition, the holes 103H may be exposed in a top of the outer side wall portion 103. According to FIG. 5B, the top end portion 103TP in the second part P2 shown in FIG. 2 does not include any hole.

Referring to FIG. 4 again, when a hot beverage is poured into a cup 101, the surface temperature of the cup 101 rises to an extremely high degree in a few seconds. The air gap 105 can provide of good insulation properties because the holes 103H allows the hot air in the air gap 105, by heat transmission from the cup 101, to escape from the air gap 105 to outside and at the same time, cool air coming from outside through the holes 103H can fill the air gap 105.

Figure 6:
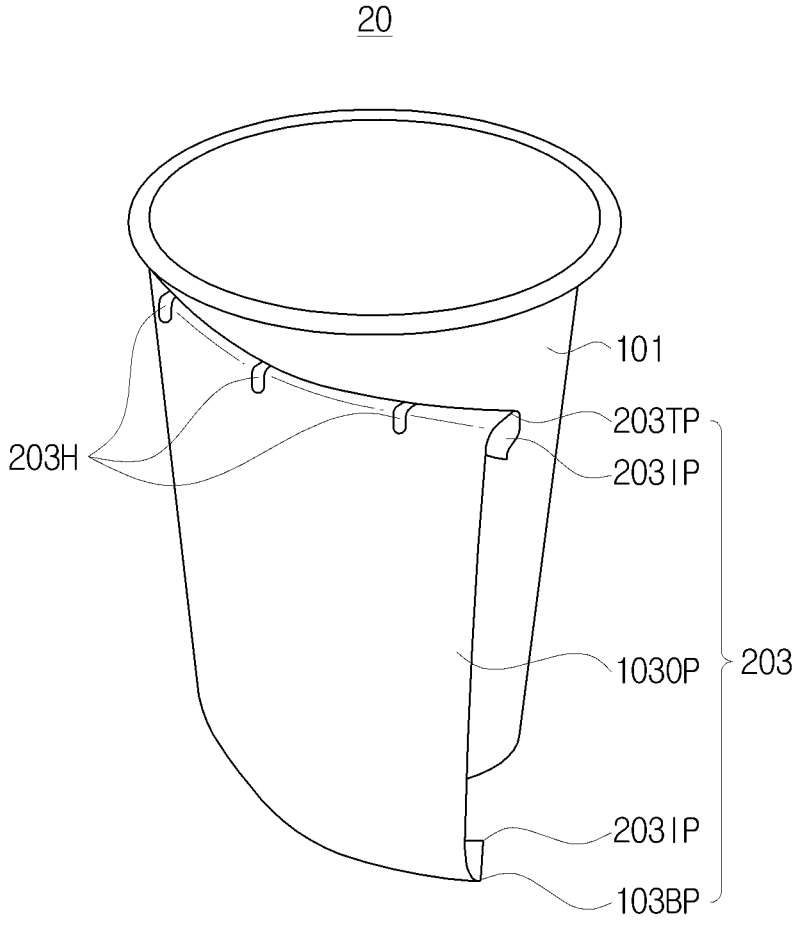
FIG. 6 shows a perspective view of the container 20 according to another embodiment of the present invention with a protective member 203 partly taken off from a cup 101.
Figure 7:
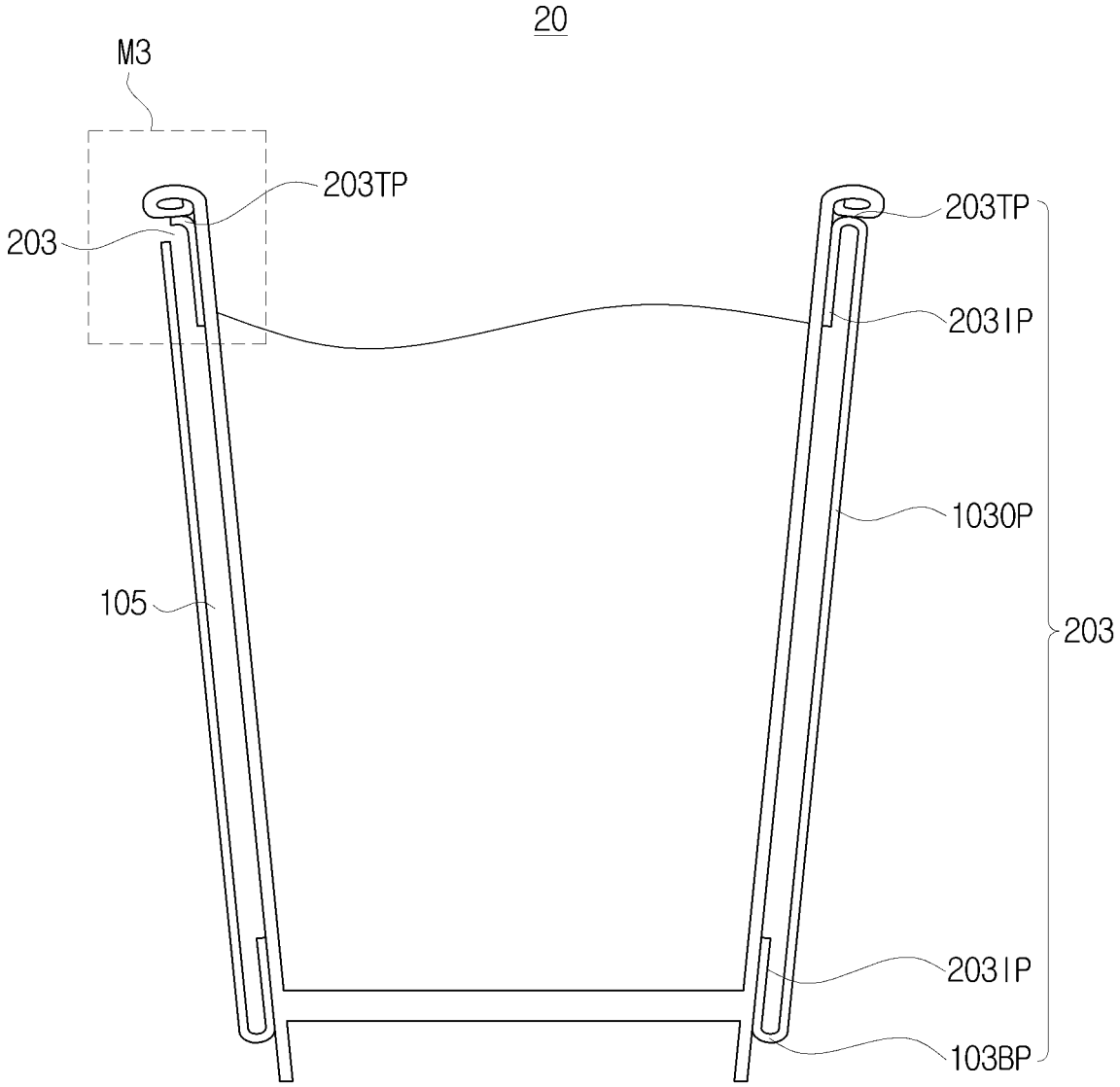
FIG. 7 shows a cross-sectional view of the container 20 of the FIG. 6.
Figure 8:
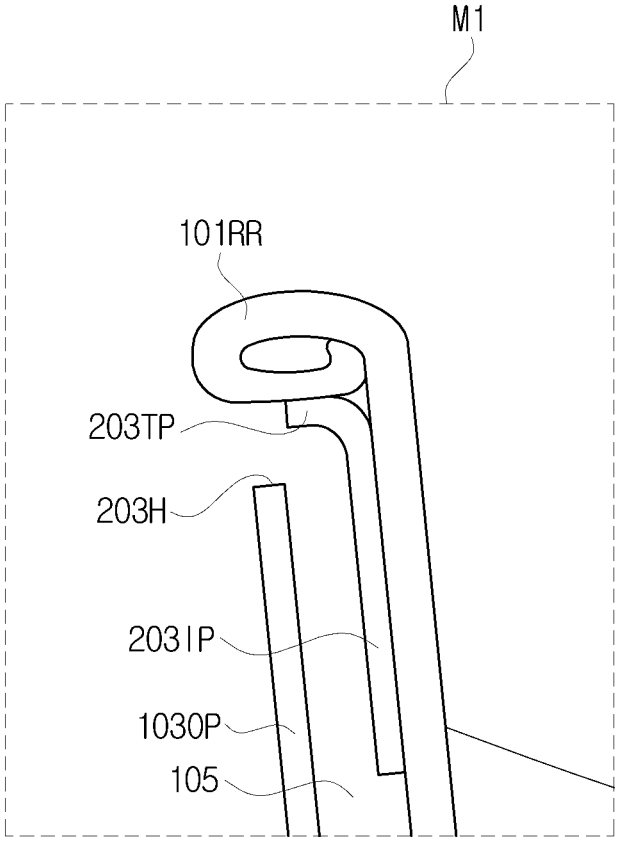
FIG. 8 is a close-up partial section view of an upper portion M3 of the container 20 of FIG. 7.

FIG. 6 shows a perspective view of the container 20 according to another embodiment of the present invention with a protective member 203 partly taken off from a cup 101. FIG. 7 shows a cross-sectional view of the container 20 of the FIG. 6. FIG. 8 is a close-up partial section view of an upper portion M3 of the container 20 of FIG. 7.

According to FIGS. 6 to 8, the container 20 has a similar structure with the container 10 shown in FIGS. 1A to 5, but holes 203H formed in a top end portion 203TP does not extend to an inner side wall portion 203IP.

Figure 9:
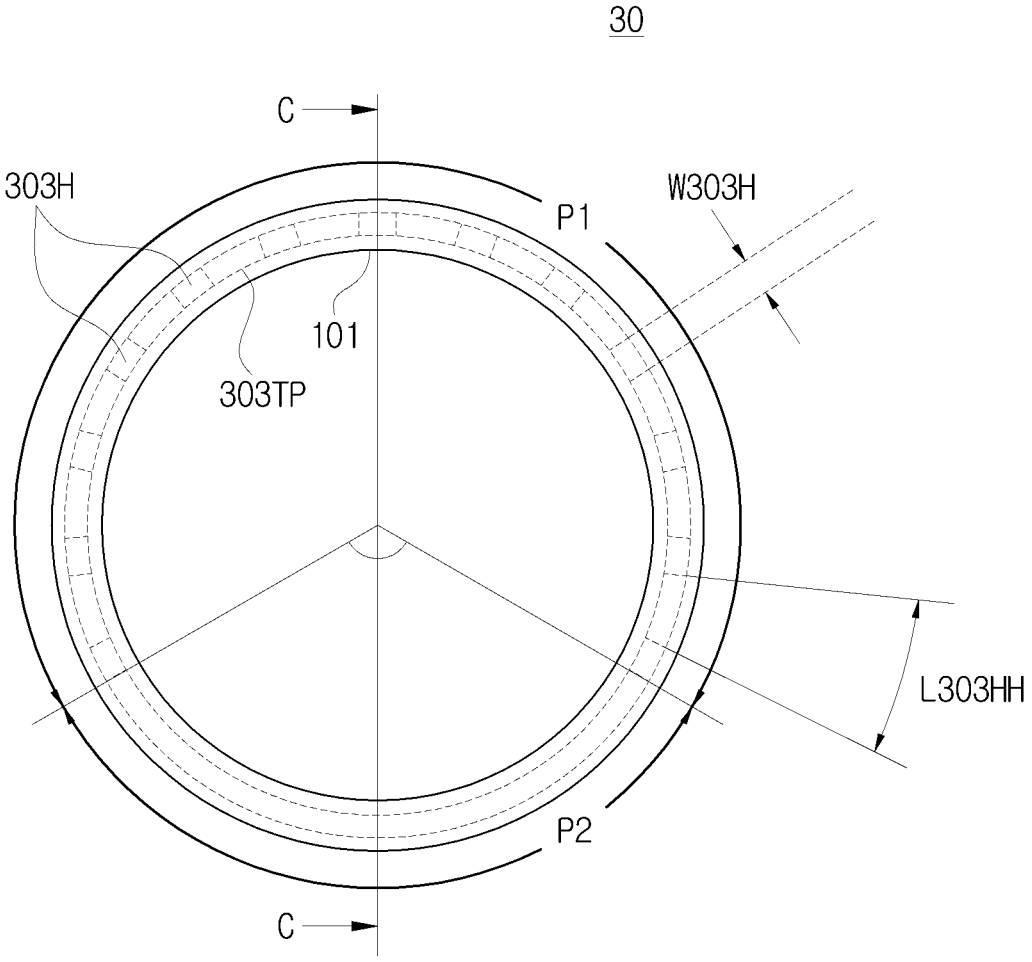
FIG. 9 shows a plan view of the container 30 according to another embodiment of the present invention.
Figure 10:
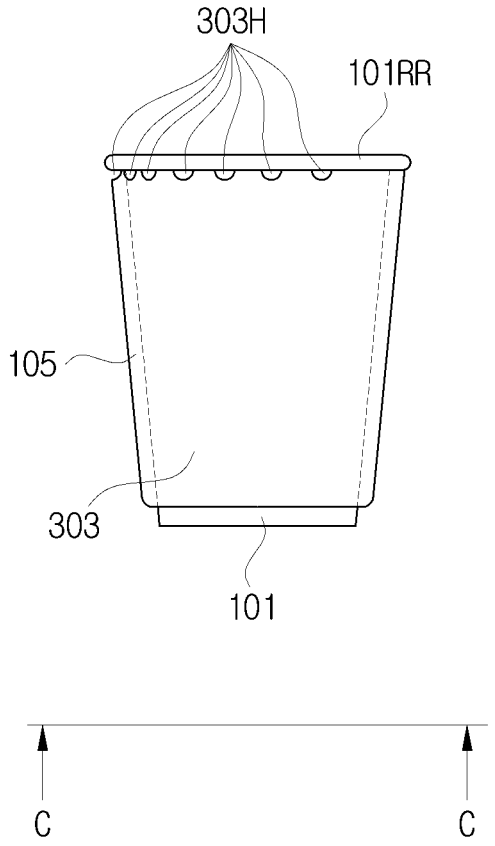
FIG. 10 shows a side view of the container 30 from line C-C shown in the FIG. 9.

FIG. 9 shows a plan view of the container 30 according to another embodiment of the present invention. FIG. 10 shows a side view of the container 30 from line C-C shown in the FIG. 9.

According to FIG. 9, holes 303H are formed in a first part P1, two thirds portion of the top end portion 303TP. The remaining one third portion of the top end portion 303TP, a second part P2, does not include any holes. The second part P2 allows users to approach and touch their mouths to the container 30 without getting burned by hot air coming from the holes 303H. A length L303HH between adjacent holes 303H along the circumference of the top end portion 303TP is longer a diameter W303H of each hole 303H.

Figure 11:
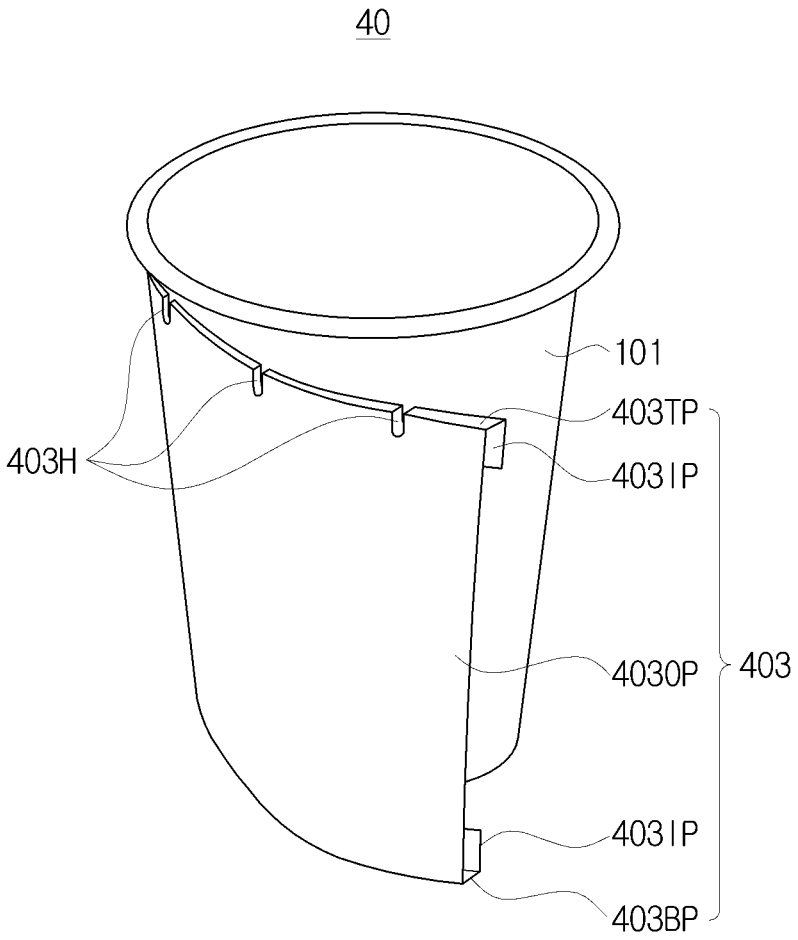
FIG. 11 shows a perspective view of the container 40 according to another embodiment of the present invention with a protective member 403 partly taken off from a cup 101.
Figure 12:
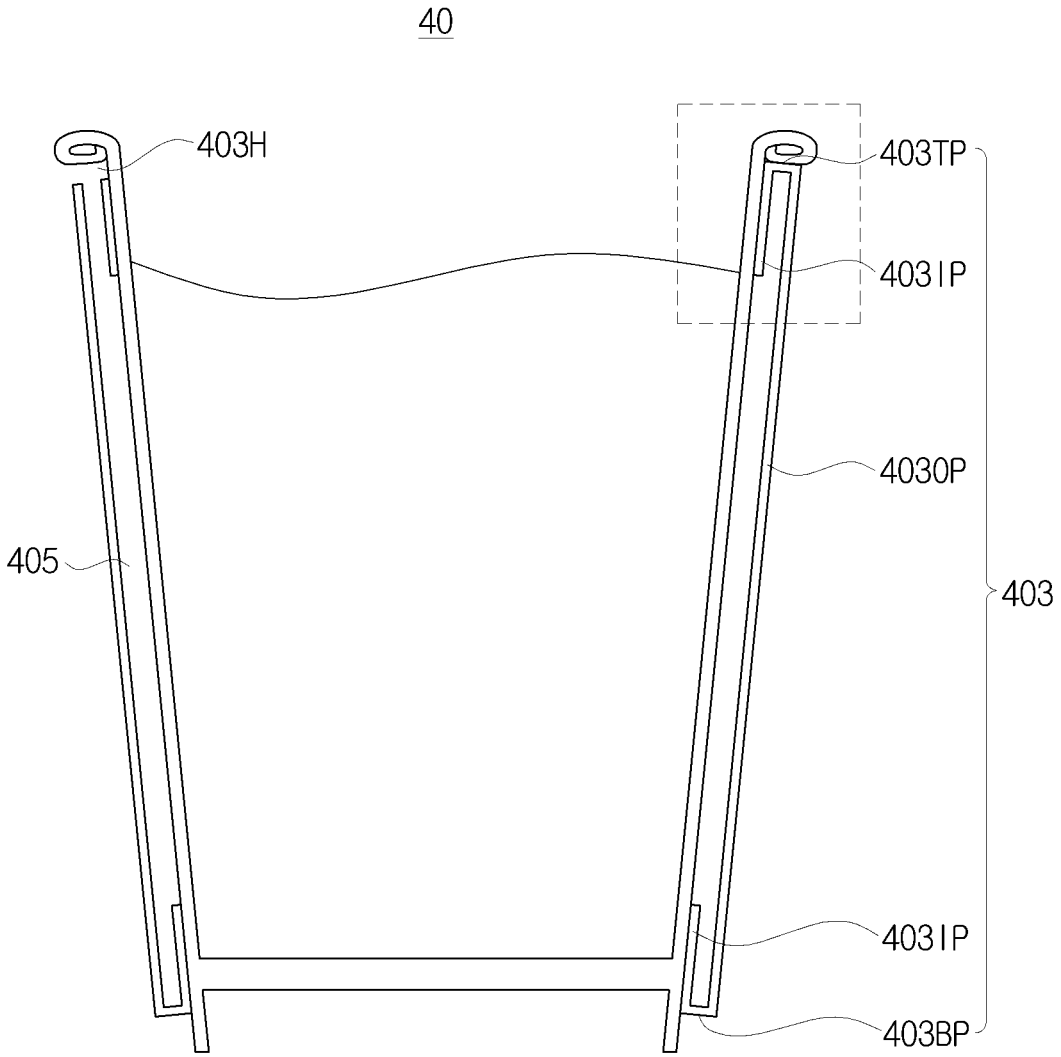
FIG. 12 shows a cross-sectional view of the container 40 of the FIG. 11.
Figure 13:
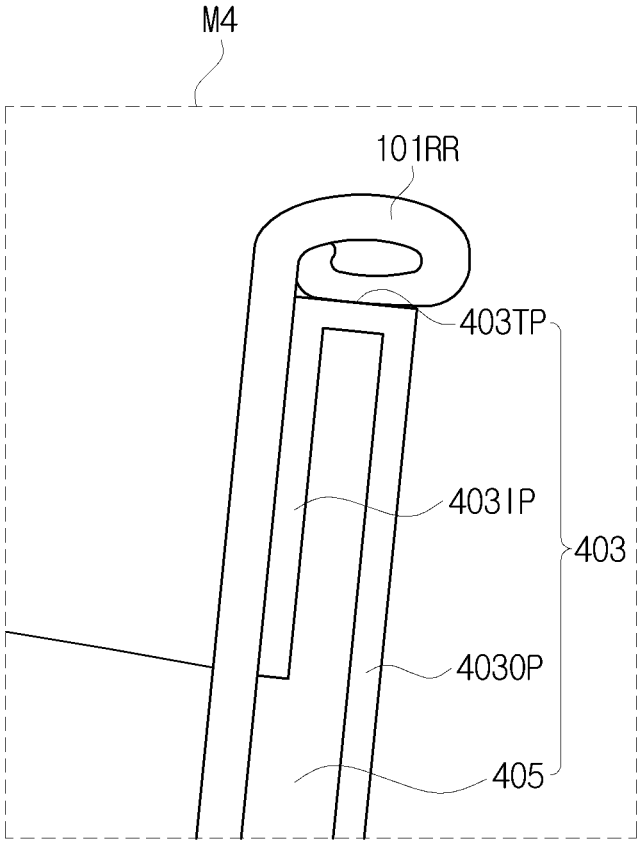
FIG. 13 is a close-up partial section view of an upper portion M4 of the container 40 of FIG. 12.

FIG. 11 shows a perspective view of the container 40 according to another embodiment of the present invention with a protective member 403 partly taken off from a cup 101. FIG. 12 shows a cross-sectional view of the container 40 of the FIG. 11. FIG. 13 is a close-up partial section view of an upper portion M4 of the container 40 of FIG. 12.

According to FIG. 11, the container 40 has a similar structure with the container 10 shown in FIGS. 1A to 5, but a top end portion 403TP and a bottom end portion 403BP of the protective member 403 are flat-shaped.

The protective member 403 may include an outer side wall portion 4030P, an inner side wall 403IP, a flat-shaped bottom end portion 403BP, and a flat-shaped top end portion 403TP. The top end portion 403TP connects between a top end of the outer side wall portion 4030P and a top end of the inner side wall portion 403IP. The outer side wall portion 4030P and the top end portion 403TP may form an angle. Likewise, the top end portion 403TP and the inner side wall portion 403IP may form an angle. The outer side wall portion 4030P and the bottom end portion 403BP may form an angle. The bottom end portion 403BP and the inner side wall portion 403IP may form an angle.

The top end portion 403TP has at least one hole 403H. The hole 403H may extend to the outer side wall portion 4030P. Therefore, the hole 403H may be exposed the top end of the outer side wall portion 4030P. In FIGS. 11 and 13, the holes 403H have a half circle shape but is not limited to. The hole 403H may also extend to the inner side wall portion 403IP but is not limited to.

An air gap 405 is formed between the side wall of the cup 101 and the protective member 403. The air gap 405 is exposed to outside through the at least one hole 403H, which enables air to flow between the air gap 405 and outside.

Figure 14:
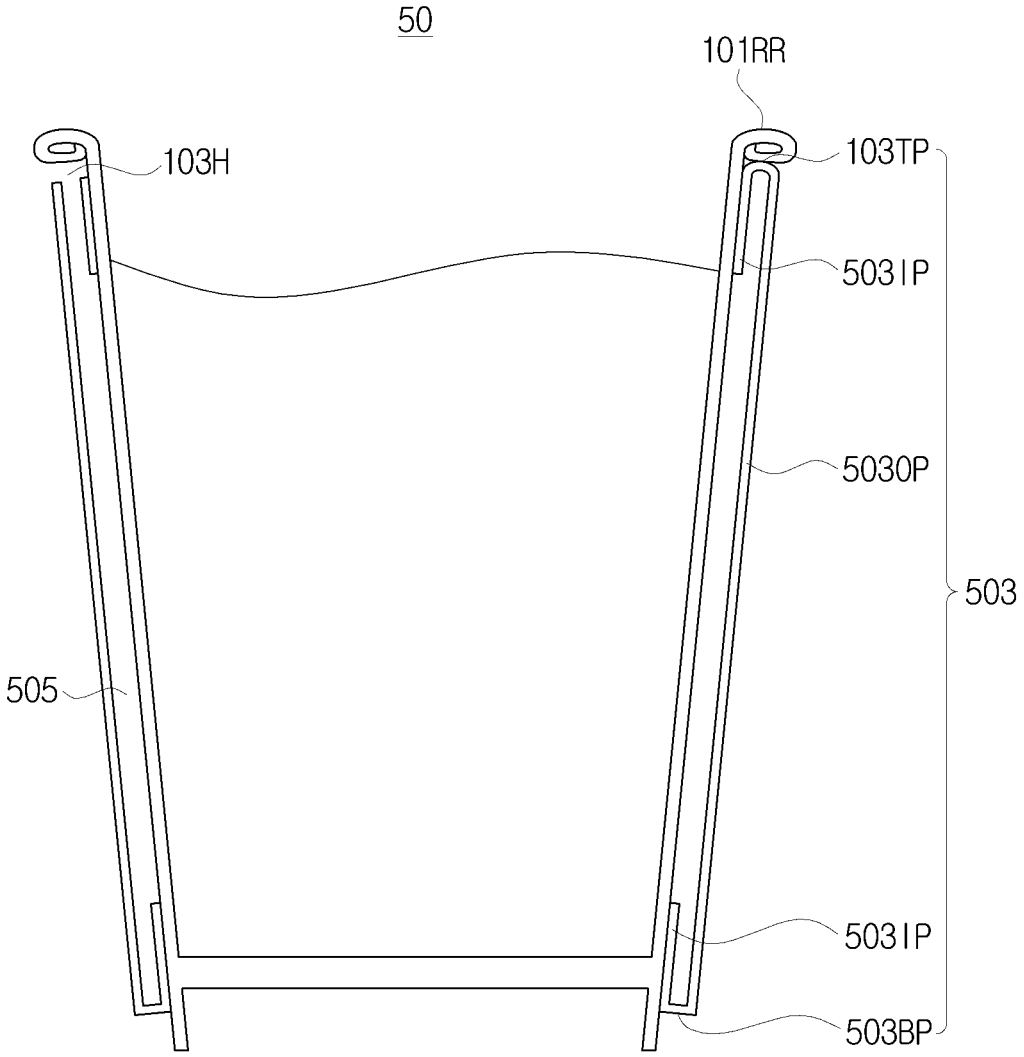
FIG. 14 shows a cross-sectional view of the container 50 according to another embodiment of the present invention.

FIG. 14 shows a cross-sectional view of the container 50 according to another embodiment of the present invention.

According to FIG. 14, the container 50 has a similar structure with the container 10 shown in FIGS. 1A to 5, but a bottom end portion 503BP of the protective member 503 is flat-shaped. A top end portion 103TP of the protective member 103 may be arch-shaped.

The outer side wall portion 5030P and the bottom end portion 503BP may form an angle. The bottom end portion 503BP and the inner side wall portion 503IP may form an angle.

Figure 15:
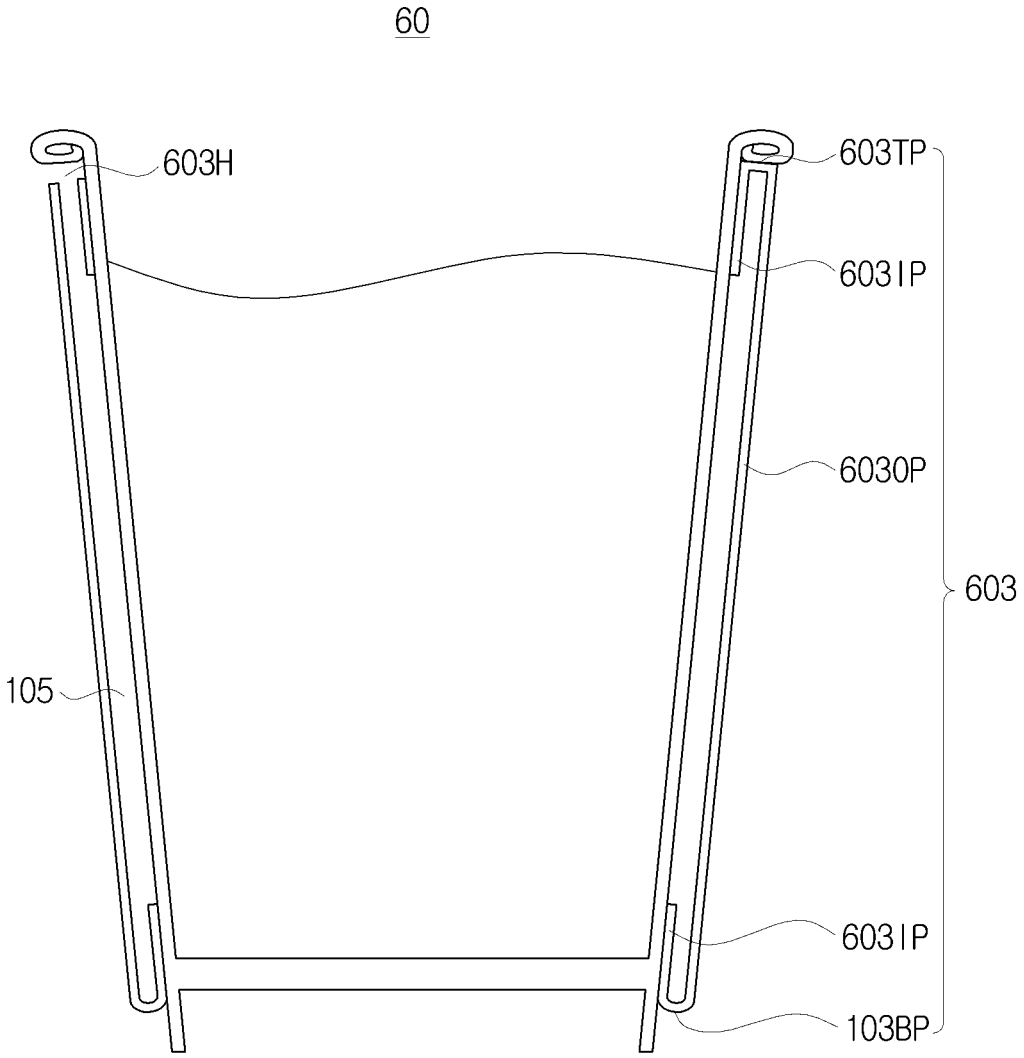
FIG. 15 shows a cross-sectional view of the container 60 according to another embodiment of the present invention.

FIG. 15 shows a cross-sectional view of the container 60 according to another embodiment of the present invention.

According to FIG. 15, the container 60 has a similar structure with the container 10 shown in FIGS. 1A to 5, but a top end portion 603TP of the protective member 603 is flat-shaped. A bottom end portion 103BP of the protective member 603 may be arch-shaped.

The outer side wall portion 6030P and the top end portion 603TP may form an angle. The top end portion 603TP and the inner side wall portion 603IP may form an angle.

Figure 16:
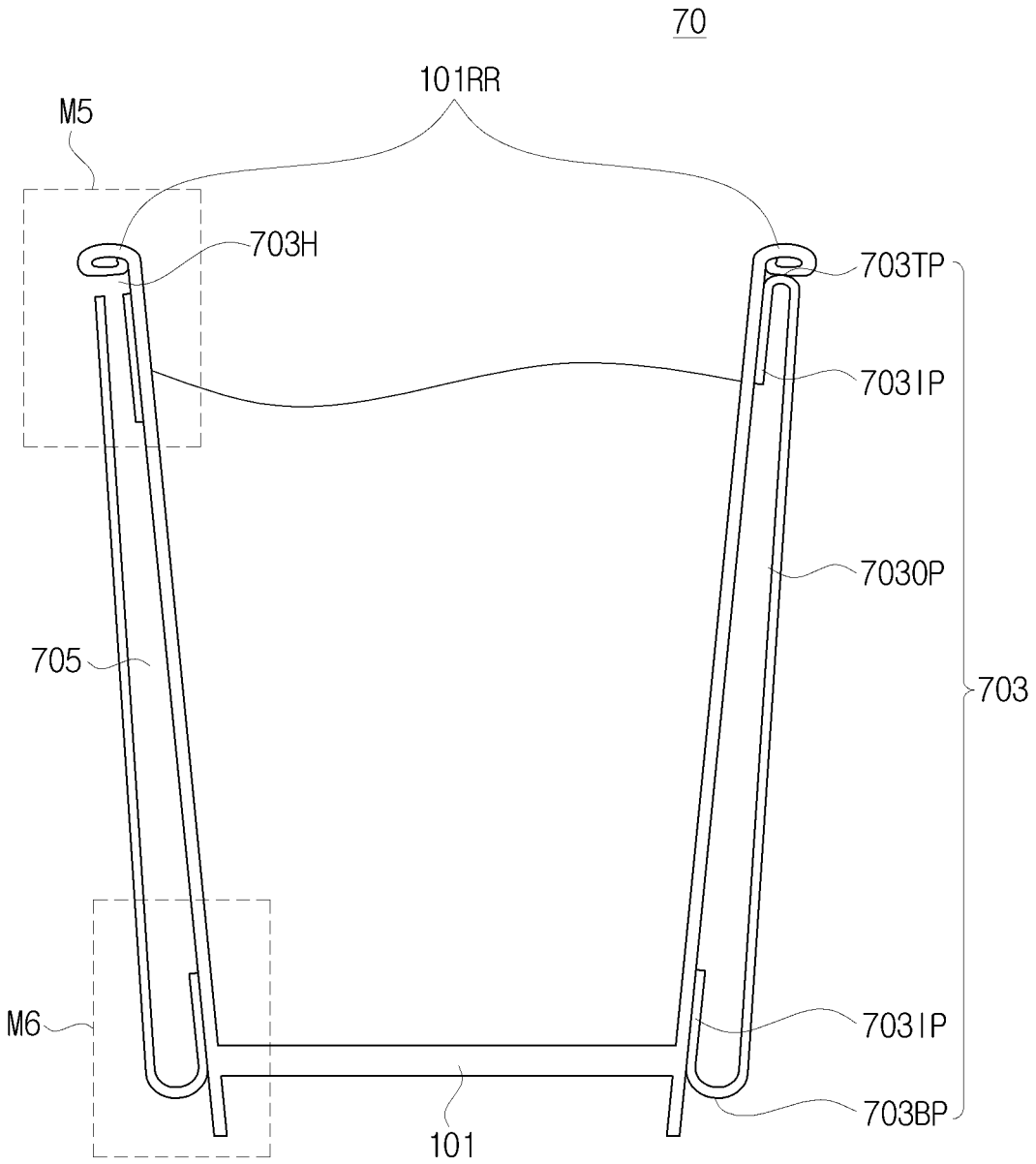
FIG. 16 shows a cross-sectional view of the container 70 according to another embodiment of the present invention.
Figure 17A:
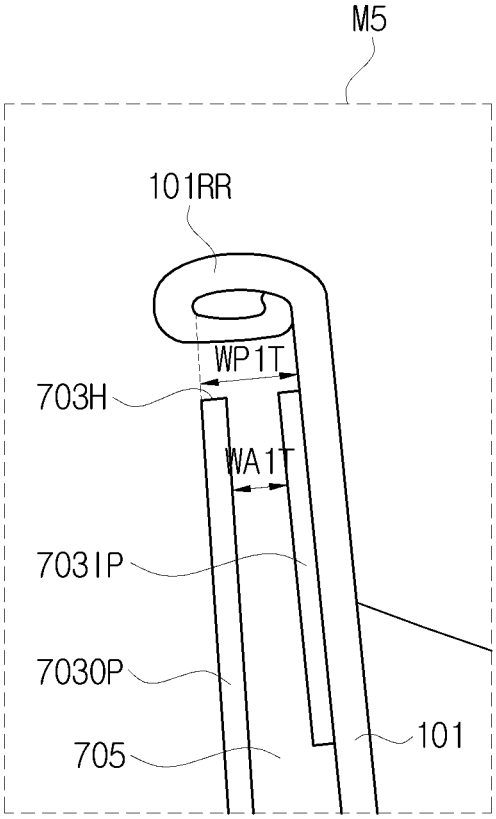
FIG. 17A is a close-up partial section view of an upper portion M5 of the container 70 of FIG. 16.
Figure 17B:
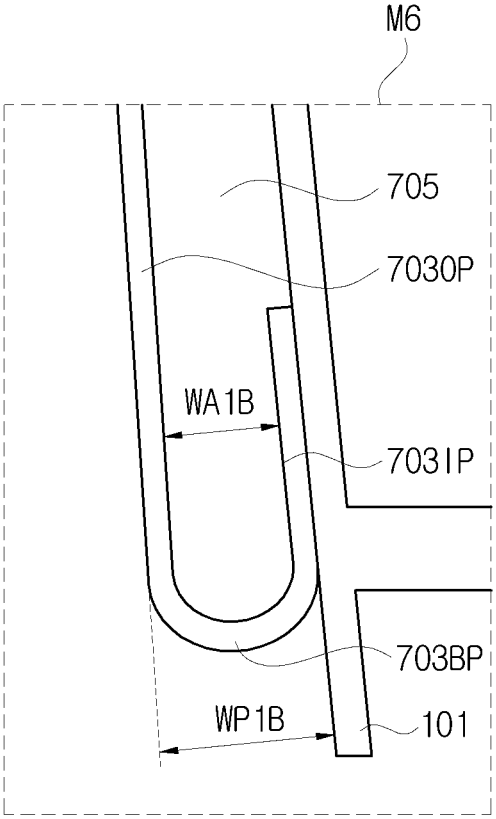
FIG. 17B is a close-up partial section view of a lower portion M6 of the container 70 of FIG. 16.

FIG. 16 shows a cross-sectional view of the container 70 according to another embodiment of the present invention. FIG. 17A is a close-up partial section view of an upper portion M5 of the container 70 of FIG. 16. FIG. 17B is a close-up partial section view of a lower portion M6 of the container 70 of FIG. 16.

According to FIG. 16, the container 60 has a similar structure with the container 10 shown in FIGS. 1A to 5, but a width WA1B of the air gap 705 at a bottom of the container 70 is wider than a width WAIT of a top of the container 70. A width WP1B of the bottom end portion 703BP of the protective member 703 is wider than a width WP1T of the top end portion 703TP of the protective member 703. The container 70 may be more effective to prevent a user to getting burned because people generally grab a bottom of the container. A top end portion 703TP and a bottom end portion 703BP of the protective member 703 may be arch-shaped.

Figure 18:
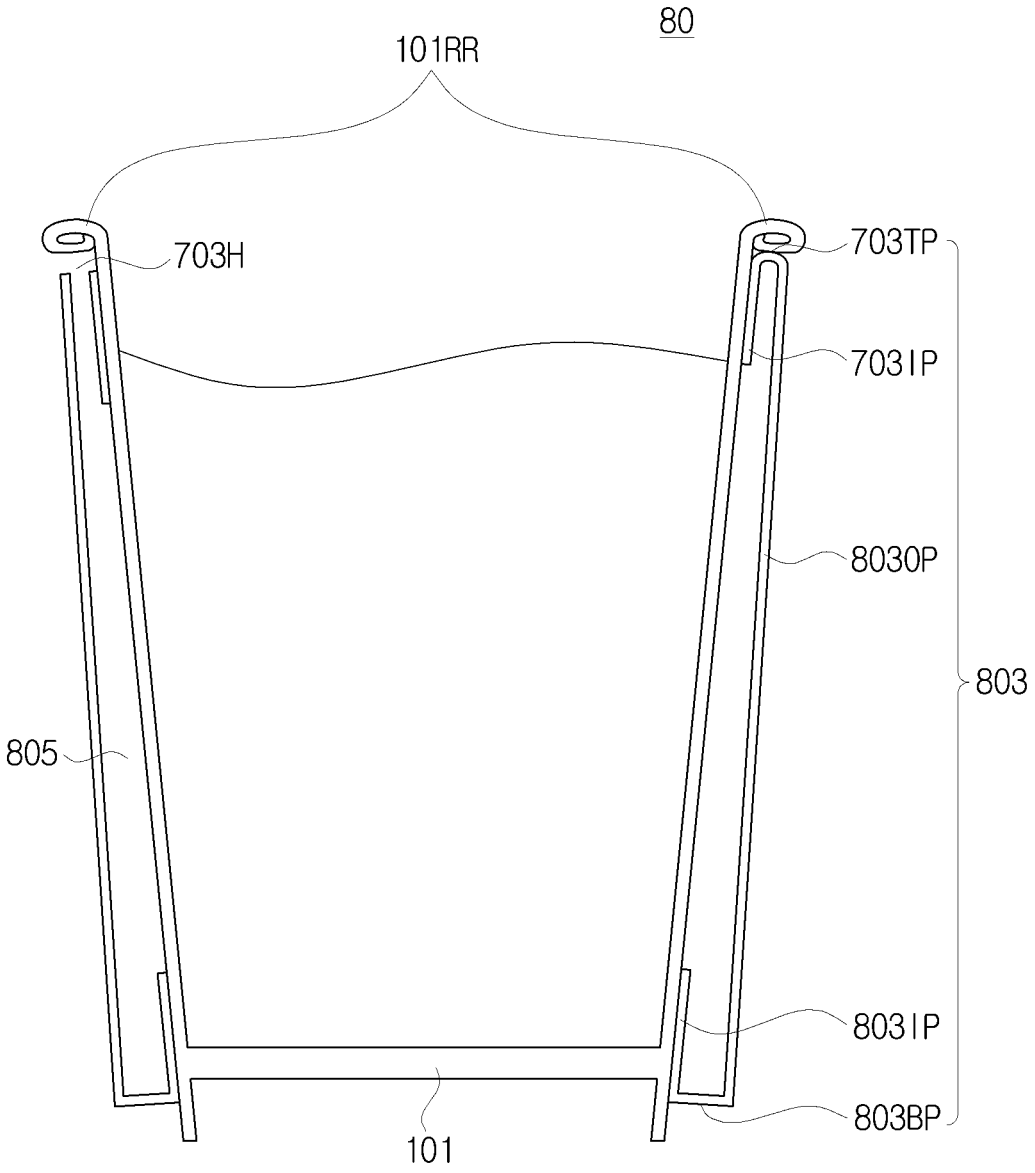
FIG. 18 shows a cross-sectional view of the container 80 according to another embodiment of the present invention.

FIG. 18 shows a cross-sectional view of the container 80 according to another embodiment of the present invention.

According to FIG. 18, the container 80 has a similar structure with the container 70 shown in FIGS. 16 to 17B, but a bottom end portion 803BP of the protective member 803 is flat-shaped. A top end portion 703TP of the protective member 803 may be arch-shaped but is not limited to. In another embodiment, the top end portion 903TP may also be flat-shaped.

Figure 19:
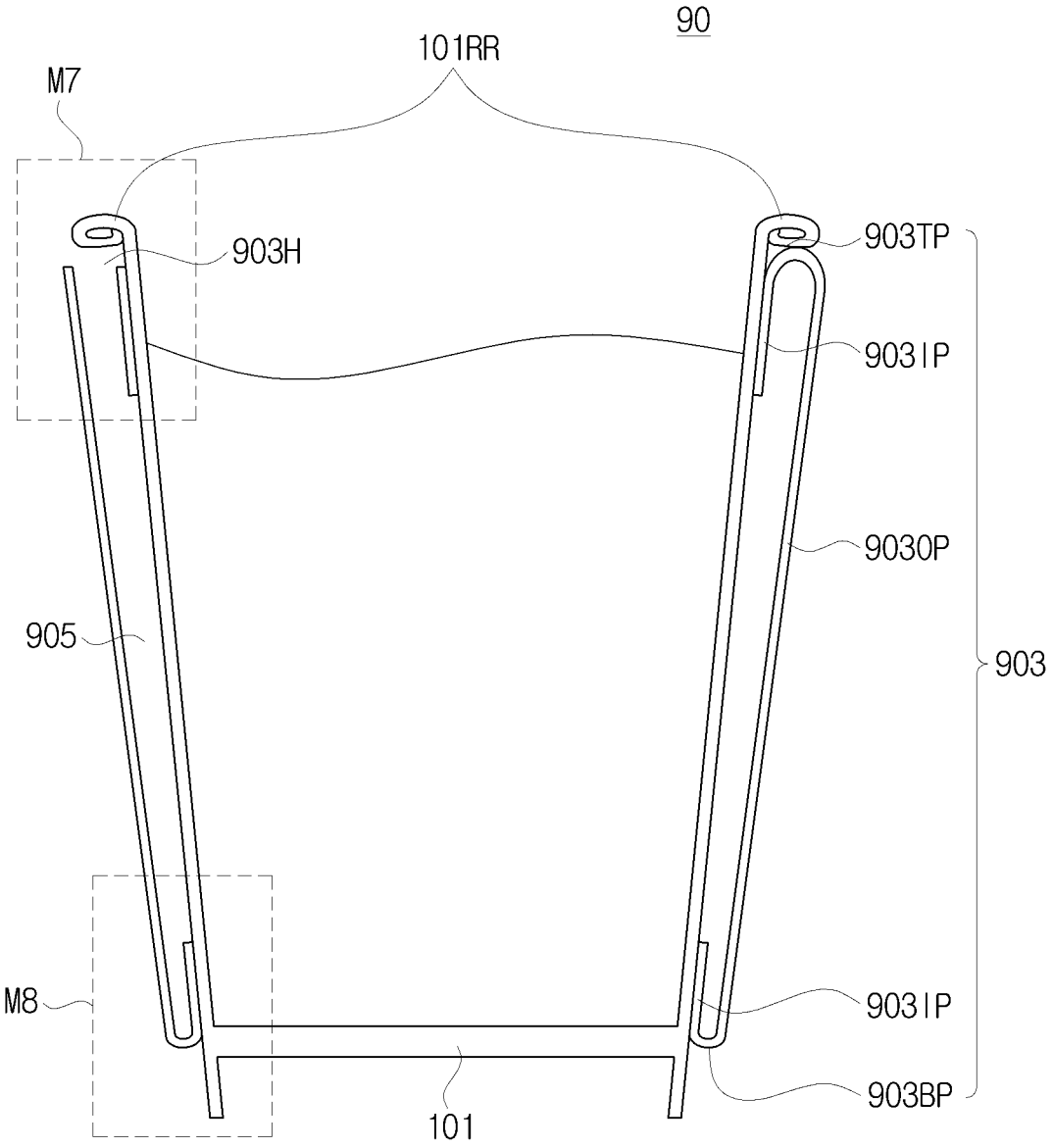
FIG. 19 shows a cross-sectional view of the container 90 according to another embodiment of the present invention.
Figure 20A:
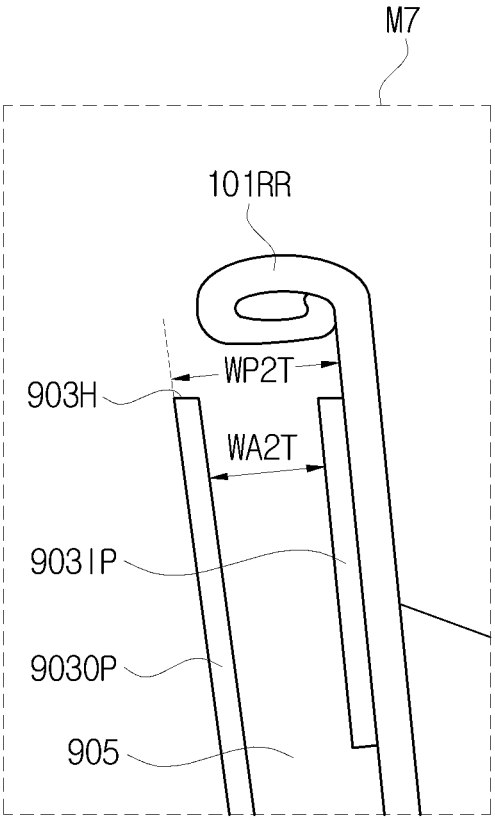
FIG. 20A is a close-up partial section view of an upper portion M7 of the container 90 of FIG. 19.

FIG. 19 shows a cross-sectional view of the container 90 according to another embodiment of the present invention. FIG. 20A is a close-up partial section view of an upper portion M7 of the container 90 of FIG. 19. FIG. 20B is a close-up partial section view of a lower portion M8 of the container 90 of FIG. 19.

According to FIGS. 19, 20A, and 20B, the container 90 has a similar structure with the container 10 shown in FIGS. 1A to 5, but a width WA2T of the air gap 905 at a top of the container 90 is wider than a width WA2B of a bottom of the container 90. A width WP2T of the top end portion 903TP of the protective member 903 is wider than a width WP2B of the bottom end portion 903BP of the protective member 903. The container 90 may be more effective to allow air to flow between the air gap 905 and outside because a size of the holes 903H can be relatively huge. The top end portion 903TP and a bottom end portion 903BP of the protective member 903 may be arch-shaped.

Figure 21:
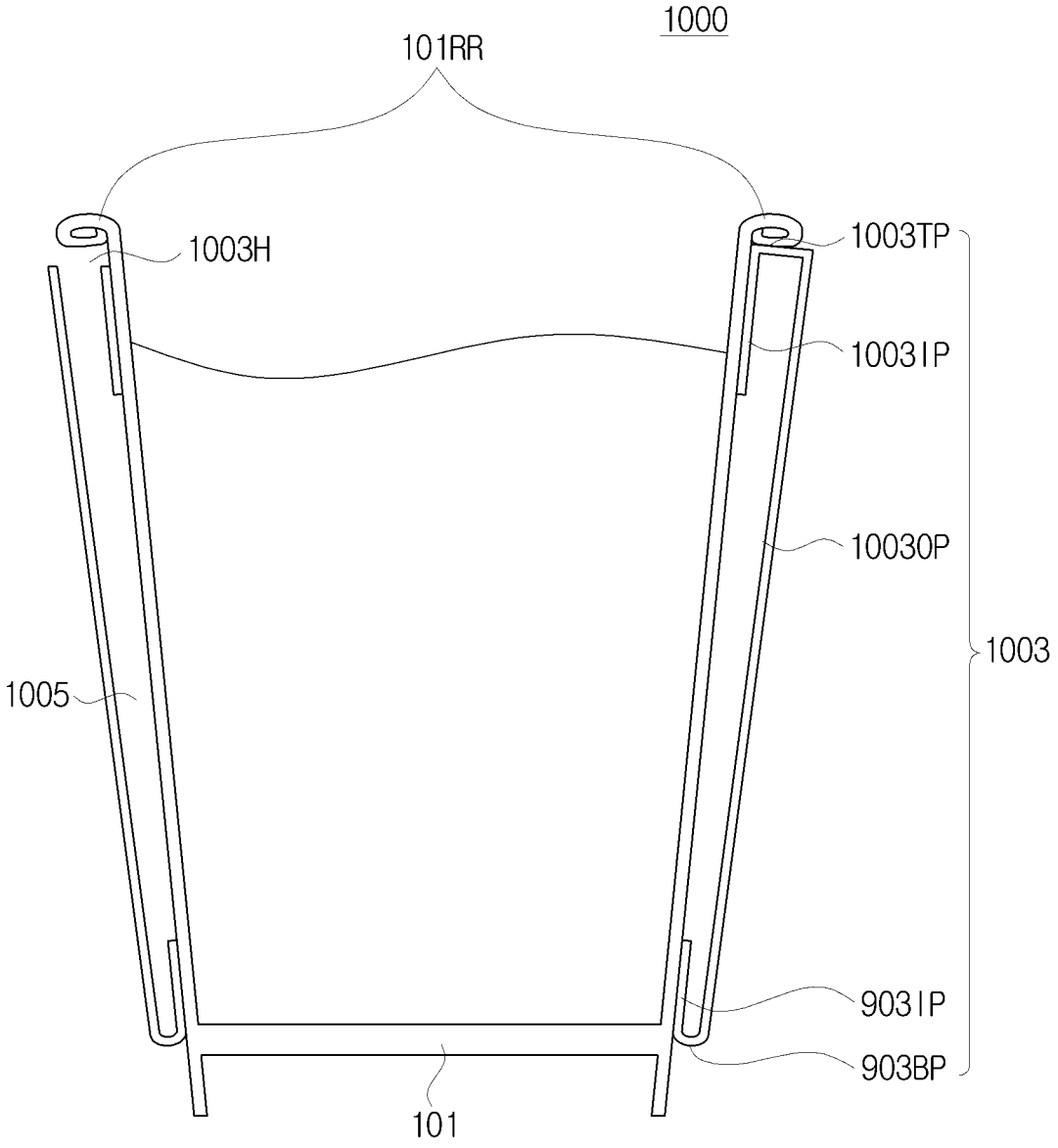
FIG. 21 shows a cross-sectional view of the container 100 according to another embodiment of the present invention.

FIG. 21 shows a cross-sectional view of the container 100 according to another embodiment of the present invention.

Figure 20A:
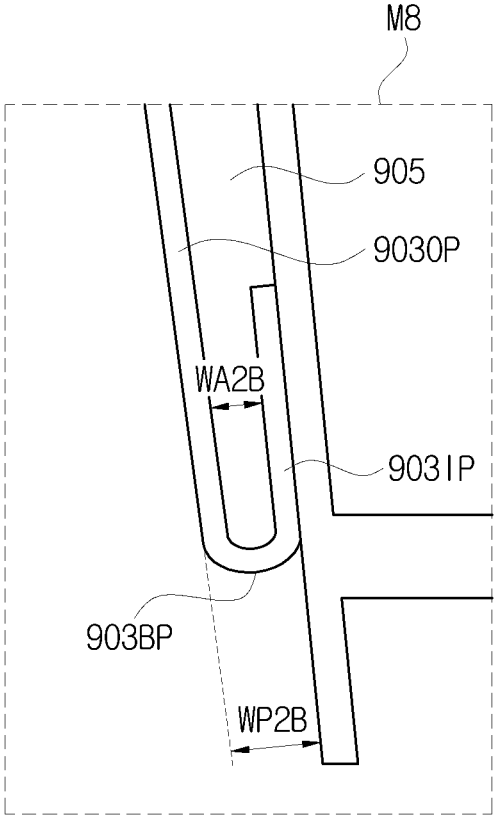

According to FIG. 21, the container 100 has a similar structure with the container 90 shown in FIGS. 19 to 20B, but atop end portion 1003TP of the protective member 1003 is flat-shaped. A bottom end portion 1003BP of the protective member 1003 may be arch-shaped but is not limited to. In another embodiment, the bottom end portion 1003BP may also be flat-shaped.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A container, comprising:

a cup;

a protective member attached to cover a side wall of the cup, a top end of the protective member includes a first inwardly rolled rim and a bottom end of the protective member include a second inwardly rolled rim;

at least one hole formed in a top end of a side wall of the protective member; and an air gap formed between a side wall of the cup and the protective member, wherein the at least hole allows air to flow between the air gap and outside, and wherein the at least one hole is plural holes, and the plural holes are formed in two thirds of the top end, and the remaining one third of the top end does not include any holes.

2. A container, comprising:

a cup having an outwardly rolled rim on a top end;

a protective member attached to cover a side wall of the cup, a top end of the protective member includes a first inwardly rolled rim and a bottom end of the protective member include a second inwardly rolled rim;

at least one hole formed in a top end of the protective member, the at least one hole facing the outwardly rolled rim of the cup; and an air gap formed between a side wall of the cup and the protective member, wherein the at least hole allows air to flow between the air gap and outside, and wherein the at least one hole is plural holes, and the plural holes are formed in two thirds of the top end, and the remaining one third of the top end does not include any holes.

3. The container of claim 2, wherein the at least one hole extends to a top of the outer side wall portion.

4. The container of claim 2, wherein a width of the air gap between a side wall of the cup and the outer side wall portion at a bottom of the container is different from that of a top of the container.

5. A container, comprising:

a cup;

a protective member attached to a side wall of the cup, the protective member including:

an outer side wall portion;

an inner side wall portion contacting the side wall of the cup;

a bottom end portion connecting between a bottom end of the outer side wall portion and a bottom end of the inner side wall portion; and a top end portion connecting between a top end of the outer side wall portion and a top end of the inner side wall portion, the top end portion having at least one hole; and an air gap formed between a side wall of the cup and the protective member, wherein the at least hole allows air to flow between the air gap and outside, and wherein the at least one hole is plural holes, and the plural holes are formed in two thirds of the top end portion, and the remaining one third of the top end portion does not include any holes.

6. The container of claim 5, wherein the at least one hole extends to a top of the outer side wall portion.

7. The container of claim 5, wherein the cup includes an outwardly rolled rim on a top end, and the at least one hole faces the outwardly rolled rim of the cup.

8. The container of claim 5, wherein the top end portion and the bottom end portion are arch-shaped.

9. The container of claim 5, wherein the top end portion is arch-shaped, and the bottom end portion is flat-shaped.

10. The container of claim 5, wherein the top end portion is flat-shaped, and the bottom end portion is arch-shaped.

11. The container of claim 5, wherein the top end portion and the bottom end portion are flat-shaped, is flat-shaped.

12. The container of claim 5, wherein a width of the air gap between a side wall of the cup and the outer side wall portion is wider at a bottom of the container than a top of the container.

13. The container of claim 12, wherein a width of the bottom end portion of the protective member is wider than that of the top end portion of the protective member.

14. The container of claim 12, wherein the bottom end portion is flat-shaped.

15. The container of claim 5, wherein a width of the air gap at a bottom of the container is wider than that of the air gap at a top of the container.

16. The container of claim 15, wherein a width of the top end portion of the protective member is wider than that of the bottom end portion of the protective member.

17. The container of claim 15, wherein the top end portion is flat-shaped.

18. The container of claim 5, wherein a length between adjacent holes of the plural holes along the circumference of the top end portion is longer than a diameter of each hole.

* * * * *